US005577451A

United States Patent [19]

Yeh

[11] Patent Number: 5,577,451

[45] Date of Patent: Nov. 26, 1996

[54] DESK AND THE LIKE HAVING APRONS FASTENED THERETO

[76] Inventor: Thomas Yeh, No. 66, Goang Huey, Goang An Tsuen, Wann Dan Hsian, Pyng Dong Hsien, Taiwan

[21] Appl. No.: 492,155

[22] Filed: Jun. 19, 1995

[51] Int. Cl.[6] ..... A47B 47/00

[52] U.S. Cl. ..... 108/156; 248/188

[58] Field of Search ..... 108/153, 155, 108/156, 158; 248/188, 188.91

[56] References Cited

U.S. PATENT DOCUMENTS

| | | | |
|---|---|---|---|
| 533,766 | 2/1895 | Williams | 108/156 |
| 2,603,545 | 7/1952 | Haven | 108/156 |

FOREIGN PATENT DOCUMENTS

| | | | |
|---|---|---|---|
| 0994516 | 11/1951 | France | 248/188 |
| 1062927 | 12/1953 | France | 248/188 |
| 0120342 | 5/1881 | Germany | 248/188 |
| 0806476 | 7/1949 | Germany | 108/156 |

*Primary Examiner*—James R. Brittain
*Assistant Examiner*—Gerald A. Anderson
*Attorney, Agent, or Firm*—Browdy and Neimark

[57] ABSTRACT

A desk comprises a desk top, four aprons and four legs. The aprons and the legs are fastened with the underside of the desk top. Two adjoining aprons of the desk are fastened by a fastening member having one end that is made integrally with one of the two adjoining aprons. Another one of the two adjoining aprons is provided with a locating portion for locating a free end of the fastening member. Each of four legs is fastened at the top thereof with two adjoining aprons and the fastening member.

5 Claims, 2 Drawing Sheets

DESK AND THE LIKE HAVING APRONS FASTENED THERETO

FIELD OF THE INVENTION

The present invention relates generally to a furniture, and more particularly to an improved desk having aprons fastened thereto.

BACKGROUND OF THE INVENTION

As shown in FIG. 1, a conventional desk 10 comprises a desk top 12, four aprons 14, and four legs 16. The aprons 14 and the legs 16 are fastened respectively with the underside of the desk top 12. As shown in FIG. 2, the aprons 14 and the legs 16 are fastened by means of four fastening members 18, each of which is fastened respectively at both ends thereof with the aprons 14 with a fastening bolt and is provided centrally with a through hole 19. Each of four legs 16 is provided at the top thereof with two fastening surfaces 22 spaced at a predetermined angle. Located between two fastening surfaces 22 is a threaded hole 24 engageable with a bolt 26 for fastening the apron 14 and the leg 16.

Such a fastening means as described above is defective in design in that the fastening members 18 are made separately and are therefore not cost-effective.

SUMMARY OF THE INVENTION

It is therefore the primary objective of the present invention to provide a desk and the like with aprons which can be made and fastened economically.

The foregoing objective of the present invention is attained by a desk which is characterized in that two adjoining aprons of the desk are fastened by a fastening member having one end that is made integrally with one of the two adjoining aprons, and that another one of the two adjoining aprons is provided with a locating portion for locating the free end of the fastening member.

The foregoing objective, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
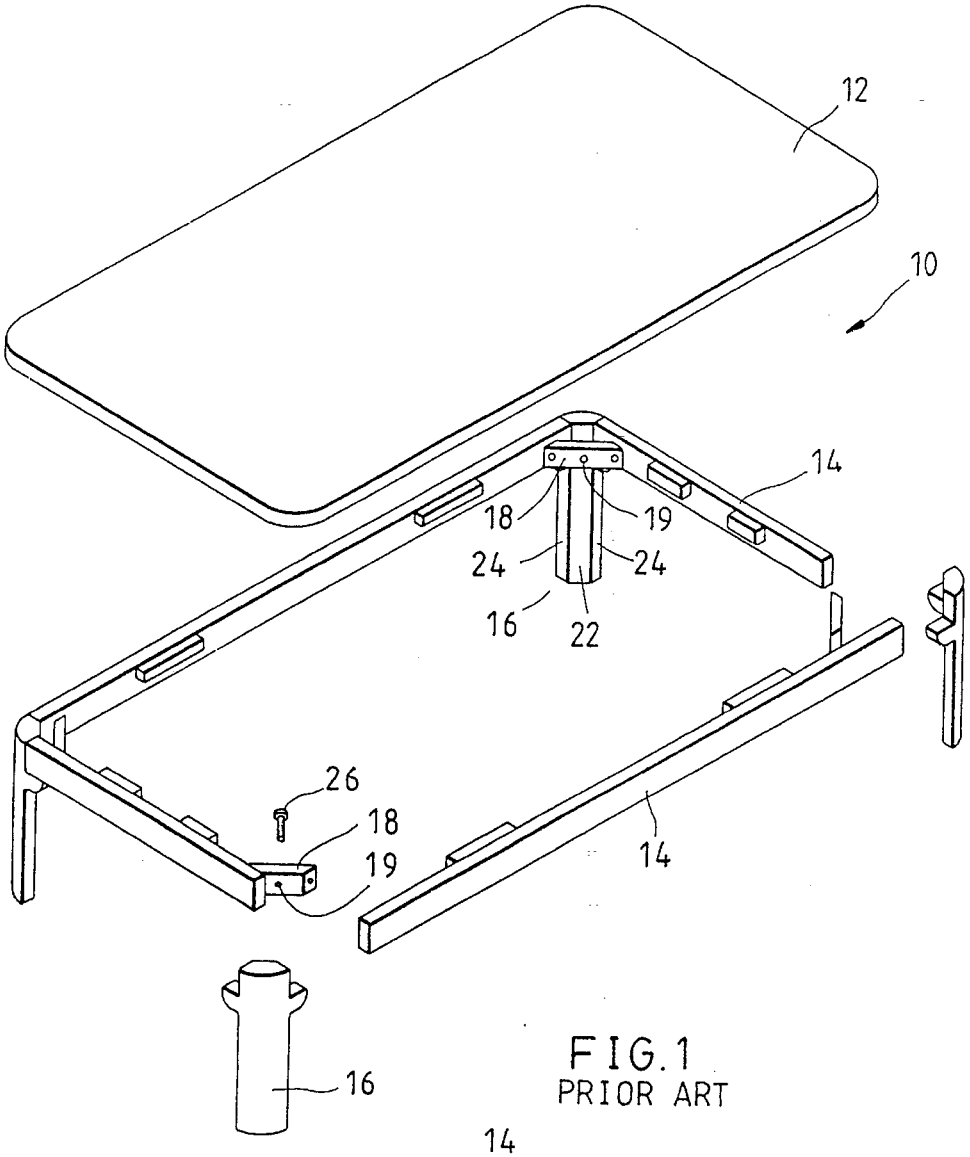
FIG. 1 PRIOR ART
FIG. 1 shows an exploded view of a prior art desk.
Figure 2:
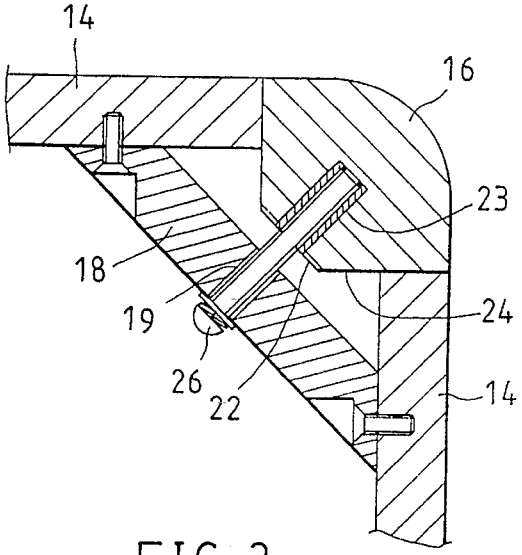
FIG. 2 PRIOR ART
FIG. 2 shows a sectional view of a fastening means by which two aprons are fastened with a leg of the prior art desk as shown in FIG. 1.
Figure 3:
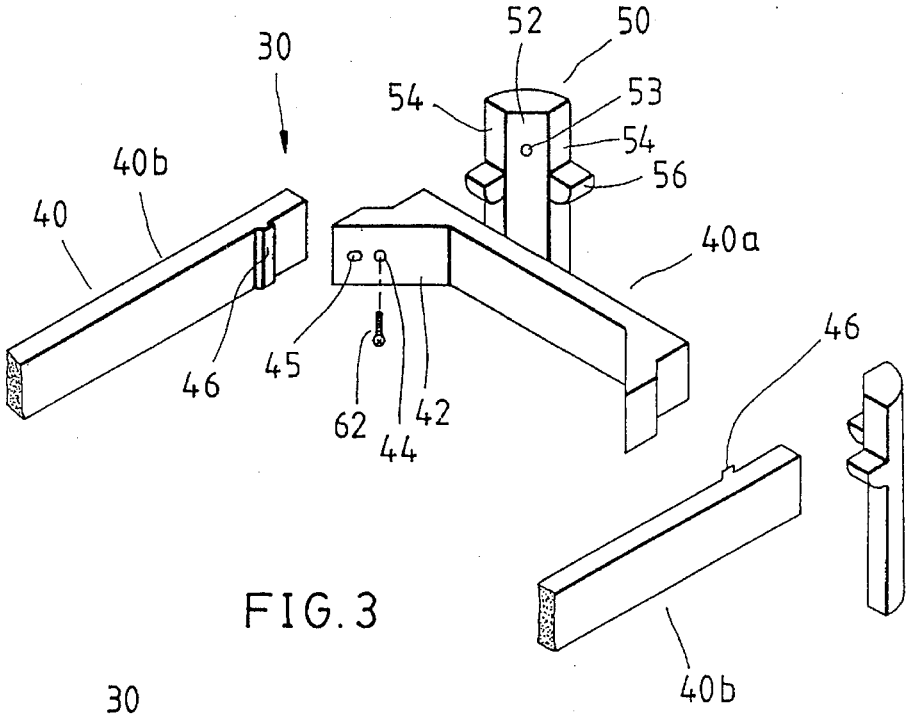
FIG. 3 shows an exploded view of a first preferred embodiment of the present invention.
Figure 4:
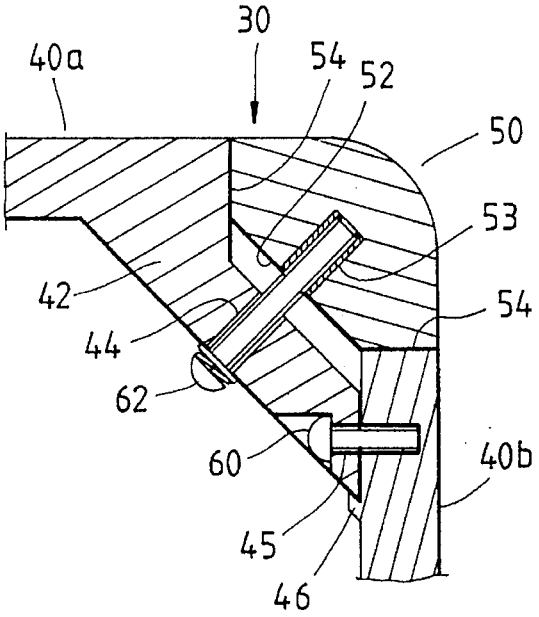
FIG. 4 shows a sectional view of the first preferred embodiment in combination according to the present invention.

As shown in FIGS. 3 and 4, a desk of the first preferred embodiment of the present invention comprises a desk top (not shown in the drawings), four aprons 40, and four legs 50.

Four aprons 40 include two long ones and two short ones and are made by a specific molding method invented by this inventor of the present invention. One of two adjoining aprons 40 is designated as 40*a* which is provided integrally with a fastening portion 42 having a round hole 44 and a free end provided with a through hole 45. Another one of two adjoining aprons 40 is designated as 40*b* which has a locating portion 46.

Four legs 50 are provided respectively with an inner surface 52 having a metal nut 53 embedded thereinto. Located respectively on both longitudinal sides of the inner surface 52 is a fastening surface 54 having thereon a receiving portion 56.

In combination, four aprons 40 are fastened with the underside of the desk top such that the fastening protion 42 of the apron 40*a* is fastened at the free end thereof with the locating portion 46 of another apron 40*b*, as shown in FIG. 4. Aprons 40*a* and 40*b* are further fastened securely by means of a bolt 60 engaging the through hole 45. Each leg 50 is fastened at the top thereof with aprons 40*a* and 40*b* such that both fastening surfaces 54 of the leg 50 are fastened respectively with the aprons 40*a* and 40*b*, and that the nut 53 embedded in the inner surface 52 of the leg is engaged with a bolt 62 which is received in the roung hole 44 of the fastening portion 42 of the apron 40*a*.

Figure 5:
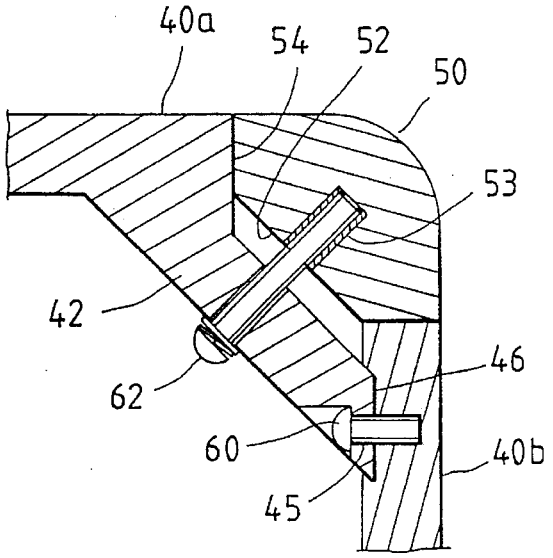
FIG. 5 shows a sectional view of a second preferred embodiment of the present invention.

As shown in FIG. 5, the second preferred embodiment of the present invention is different from the first preferred embodiment in that the former comprises two adjoining aprons 40, one of which is designated as 40*b* having a locating portion 46 of a rectangular recess for locating the free end of the fastening portion 42 of another apron 40*a* contiguous to the apron 40*b*.

It is readily apparent that the present invention is relatively cost-effective, thanks to the fastening portion 42 which is made integrally with the apron 40*a*. In addition, two adjoining aprons 40*a* and 40*b* of the present invention can be fastened easily and rapidly by locating the free end of the fastening portion 42 of the apron 40*a* by the locating portion 46 of another apron 40*b*.

The embodiments of the present invention described above are to be regarded in all respects as merely illustrative and not restrictive. Accordingly, the present invention may be embodied in other specific forms without deviating from the spirit thereof. For example, two adjoining aprons 40 of the present invention may be provided interchangeably with the fastening portion 42 and the locating portion 46. The present invention is therefore to be limited only by the scope of the following appended claims.

What is claimed is:

1. A desk and the like comprising:

a predetermined number of aprons which are fastened with an underside of a desk top such that two of said aprons are adjacent to each other;

a plurality of fastening portions equal in number to said aprons and having respectively a fastening hole and a threaded hole engageable with a fastening means for fastening said two adjoining aprons; and a plurality of legs equal in number to said aprons and having respectively a fastening side provided with a fastening nut embedded thereinto and engageable with a fastening bolt which is also engageable with said fastening hole of said fastening portion, said legs further having respectively two fastening surfaces located on both sides of said fastening side of said leg, said leg being fastened at a top thereof with said two adjoining aprons such that said two fastening surfaces of said leg are attached respectively to said two adjoining aprons;

wherein each of said fastening portions is made integrally with one of said adjoining aprons and is provided with a free end engageable with a locating portion of another one of said. two adjoining aprons.

2. The desk and the like as defined in claim 1, wherein said locating protion is a protruded edge located along a longitudinal axis thereof.

3. The desk and the like as defined in claim 1, wherein said locating portion is of a recessed construction.

4. The desk and the like as defined in claim 1, wherein one of said two adjoining aprons is provided respectively at both ends thereof with said fastening portion; and wherein another one of said two adjoining aprons is provided respectively at both ends thereof with said locating portion.

5. The desk and the like as defined in claim 1, wherein said aprons are provided respectively at one end thereof with said fastening portion and at another end thereof with said locating portion.

* * * * *